US008819969B1

(12) United States Patent
Cissell

(10) Patent No.: US 8,819,969 B1
(45) Date of Patent: Sep. 2, 2014

(54) THRESHOLD SIGN

(71) Applicant: Jeanette A. Cissell, Liberty Township, OH (US)

(72) Inventor: Jeanette A. Cissell, Liberty Township, OH (US)

( * ) Notice: Subject to any disclaimer, the term of this patent is extended or adjusted under 35 U.S.C. 154(b) by 0 days.

(21) Appl. No.: 14/045,754

(22) Filed: Oct. 3, 2013

(51) Int. Cl.

| | |
|---|---|
| ***G09F 7/00*** | (2006.01) |
| ***G09F 3/02*** | (2006.01) |
| ***E06B 1/70*** | (2006.01) |
| ***G09F 19/22*** | (2006.01) |

(52) U.S. Cl.
CPC ... *G09F 3/02* (2013.01); *E06B 1/70* (2013.01); *G09F 19/228* (2013.01)
USPC ..... 40/584; 49/467

(58) Field of Classification Search
None
See application file for complete search history.

(56) References Cited

U.S. PATENT DOCUMENTS

| | | | | |
|---|---|---|---|---|
| 1,901 | A * | 12/1840 | Kirkpatrick | 49/471 |
| 448,501 | A * | 3/1891 | Bussert | 49/471 |
| 586,467 | A * | 7/1897 | Vogel | 49/471 |
| 4,807,392 | A * | 2/1989 | Kirk | 43/131 |
| 6,044,600 | A * | 4/2000 | McCollough | 52/209 |
| 6,785,992 | B2 | 9/2004 | Chiarucci | |
| 7,339,488 | B2 * | 3/2008 | Pennington et al. | 340/691.1 |
| 8,046,943 | B2 | 11/2011 | Kay | |
| 8,302,337 | B2 | 11/2012 | Savagian et al. | |
| 8,393,572 | B2 * | 3/2013 | Budinger et al. | 244/118.5 |
| 8,739,469 | B1 * | 6/2014 | Fortun et al. | 49/460 |
| 2001/0013185 | A1 * | 8/2001 | Chien | 40/544 |
| 2001/0049894 | A1 | 12/2001 | Ingraham | |
| 2003/0217494 | A1 * | 11/2003 | Chiarucci | 40/584 |
| 2005/0120606 | A1 * | 6/2005 | Stanley | 40/584 |

* cited by examiner

*Primary Examiner* — Gary Hoge
(74) *Attorney, Agent, or Firm* — R. William Graham

(57) ABSTRACT

A doorway threshold sign for use in a door threshold includes a relatively rigid substrate which includes a printed alerting indicia thereon. The substrate is of a length to extend between the door threshold and includes ends which each have a notched surface configured to receive at least a door stop of a door jamb of a door frame when the substrate is disposed on the floor between the door jambs of the door frame.

5 Claims, 1 Drawing Sheet

ISOLATION
16
18
28
14
30

ISOLATION
11
10
32
20
32
18

22
26
24
34

37
34
35

10
32

10
34
32

10
34
36

THRESHOLD SIGN

TECHNICAL FIELD OF THE INVENTION

The present invention relates to the general art of warning signs, and to the particular field of hospital room warning signs.

BACKGROUND OF THE INVENTION

Currently, there are many signs which exist in hospitals to alert the personnel of particular areas and dangers within such areas. Such areas include isolation, operating and emergency room settings where masks and gowns are mandated. The signs used include printed paper or plastic signs posted on walls or doors next to these areas.

Although such signs attempt to prevent unprotected access, there remain many instances of access because these signs do not do an effective job in alerting people. The potential hazards include the unwanted spreading of airborne infectious disease.

Visual devices have not apparently been constructed to provide the necessary additional means to adequately alert or warn of dangerous areas and existing devices appear significantly inadequate. Accordingly, many lives are affected each year because people are not adequately warned of such hazardous conditions.

In many cases, emergency room an isolation room signs are posted on the doors and walls. For a warning to be truly effective, it must warn people in areas which have yet to be affected by the particular condition, i.e., infectious airborne condition. Accordingly, there is a need for an improved warning sign that is located in an area of a doorway that will be more visibly affective to a person when attempting to enter a potentially hazardous situation.

Therefore, there is a need for an improved warning sign that is easily installed and maintained and is located in an area of a door that will be more visibly effective to a person when entering such health concerning situation.

SUMMARY OF THE INVENTION

It is an object to improve warning signs.

It is another object to reduce the risk of spreading infectious disease.

It in object to provide a doorway threshold sign.

The above-discussed disadvantages of the prior art are overcome by a threshold doorway sign to be used in conjunction with a door of which is intended to isolate or restrict access of persons or otherwise cause persons to take care prior to entering.

Accordingly, the invention is directed to a doorway threshold sign for use in a door threshold which includes a relatively rigid substrate which includes a printed alerting indicia thereon. The substrate is of a length to extend between the door threshold and includes ends which each have a notched surface configured to receive at least a door stop of a door jamb of a door frame when the substrate is disposed on the floor between the door jambs of the door frame. When so disposed, the substrate is inhibited from lateral movement when a person or object touches it. Preferably, the substrate can be made of a plastic material, though other materials are contemplated.

Other features, and advantages of the invention will be, or will become, apparent to one with skill in the art upon examination of the following figures and detailed description. It is intended that all such additional devices, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figures 1, 2, 3, 4, 5, 6A, 6B:
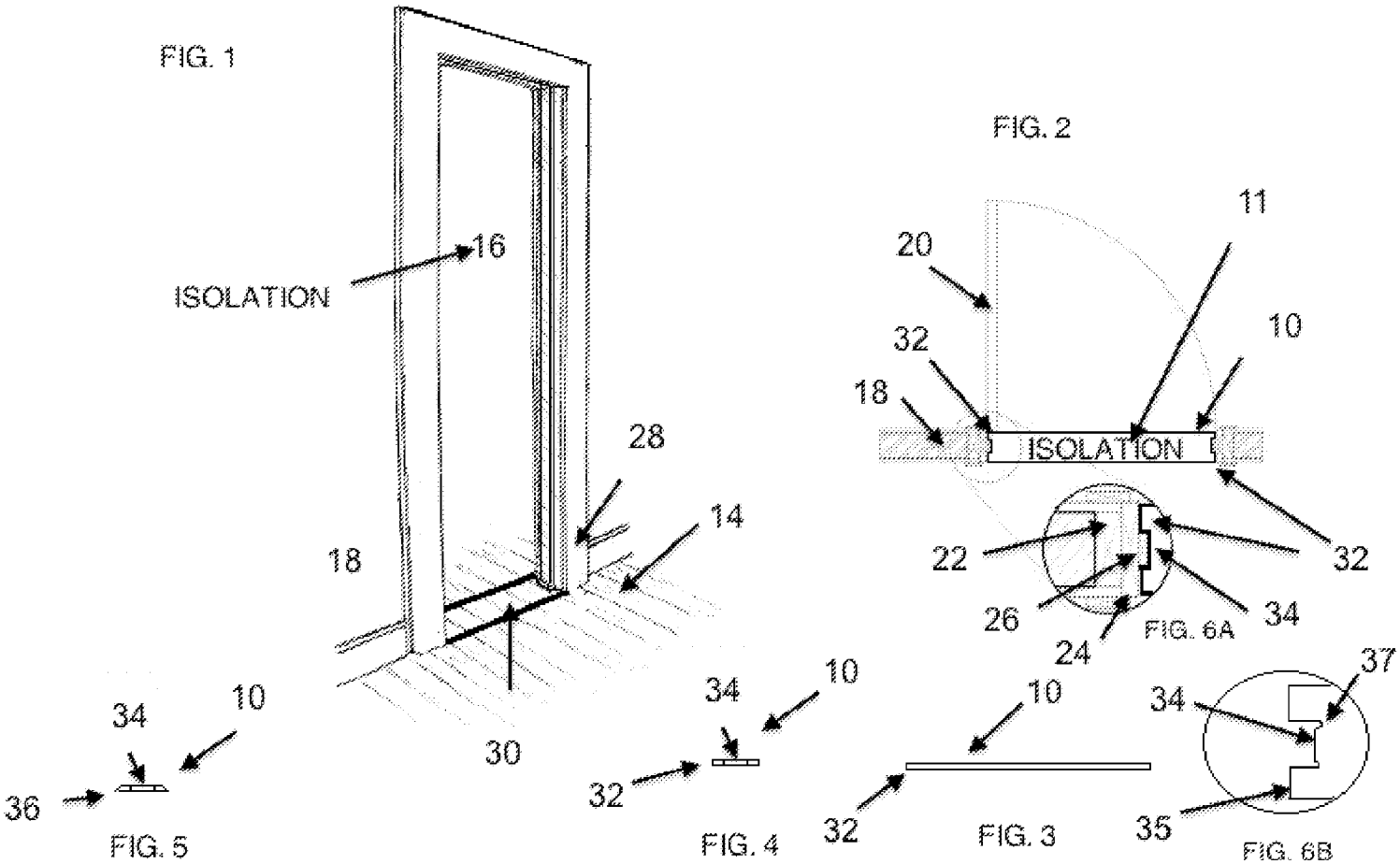
FIG. 1 is a perspective view of an isolation door embodying the present invention.
FIG. 2 is a top view of a threshold which has the doorway threshold sign therein.
FIG. 3 is a side view of the invention.
FIG. 4 is an end view of the invention.
FIG. 5 shows an end view another embodiment of the invention.
FIG. 6A shows an enlarged portion of a part of the invention.
FIG. 6B shows an enlarged portion of another aspect of the invention.

Referring to the figures, it can be understood that the present invention is embodied in a doorway threshold sign 10 that will alert persons attempting to enter a restricted area, such as in a hospital an isolated room. The location of the doorway threshold sign 10 is in a manner that will be more visibly effective to someone walking on floor 14 into room 16 defined, in part, by wall 18 in which door 20 is located. Door 20 is adapted to provide ingress to and egress from the room 16. By way of example, door 20 has a width dimension of 36 inches, for example, to provide for wheel chair access.

The door 20 has a door frame 22 which includes a door jamb 24 having a door stop 26 around inner perimeter. The door frame 22 includes a lower end 28 which when mounted in the wall 18 as shown in FIG. 1 provides a threshold area 30 for removably receiving the doorway threshold sign 10.

The doorway threshold sign 10 is for use in threshold area 30. The doorway threshold sign 10 includes a relatively rigid substrate which includes a printed alerting indicia 11 thereon (either using an adhesive sticker or paint process for example). Preferably, the substrate can be made of a plastic material, e.g., Lexan®, though other materials such as metal are contemplated. A transparent plastic is desirable to accomplish the task of receiving the printed alerting indicia while allowing the visual aesthetics of the floor be revealed therethrough.

The doorway threshold sign 10 is of a length to extend between the door threshold 30 and includes ends 32 which each have a notched surface 34 between terminal end portions 35 to define a surface configured to receive at least door stop 28 when the doorway threshold sign 10 is disposed on the floor 14 between the door jambs 24 of the door frame 22. In order to decrease stress between the terminal end portions 35 and notched surface 34, there can be provided arcuate surface portions 37 there between as seen in FIG. 6. When so disposed, the relatively substrate of doorway threshold sign 10 is generally inhibited from lateral movement when a person or object touches it as when a wheel chair rolls over it or a person walks on it. While the thickness of the doorway threshold sign 10 substrate can be relatively thin, e.g., ⅛th inch, for example, it might be desirable to have chamfered edges 36 of the substrate to provide a smooth transition and prevent trip accidents from occurring as seen in FIG. 5.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

The invention claimed is:

1. A threshold sign for use in a door threshold defined by a door frame which has door jambs and door stops, which includes:

a removable relatively rigid substrate having a printed alerting indicia thereon, said substrate is of a length to extend between the door threshold and includes ends which each have a notched surface between terminal end portions to define a surface configured to receive at least the door stop of the door frame when the substrate is disposed on a floor between the door jambs of the door frame and when so disposed on the floor between said door threshold, said substrate is generally inhibited from lateral movement.

2. The threshold sign of claim 1, wherein said substrate includes a transparent material.

3. The threshold sign of claim 1, wherein said substrate includes a non-transparent material.

4. The threshold sign of claim 1, wherein said substrate has chamfered edges.

5. The threshold sign of claim 1, which includes arcuate portions between each said notched surface and said terminal end portions.

* * * * *